United States Patent [19]

Bergl et al.

[11] Patent Number: 4,765,575

[45] Date of Patent: Aug. 23, 1988

[54] CANTILEVER SHELF SUPPORT

[75] Inventors: Rodney A. Bergl, Glenview; Richard J. Tracy, Elgin, both of Ill.

[73] Assignee: Modulus, Inc., Chicago, Ill.

[21] Appl. No.: 27,615

[22] Filed: Mar. 18, 1987

[51] Int. Cl.[4] ..... A47B 96/06

[52] U.S. Cl. ..... 248/250; 108/152

[58] Field of Search ..... 248/250, 245, 235, 237; 108/152, 107, 108, 110; 312/140.3

[56] References Cited

U.S. PATENT DOCUMENTS

| | | | |
|---|---|---|---|
| 883,323 | 3/1908 | Macduff . | |
| 2,477,771 | 8/1949 | Sanford . | |
| 3,437,214 | 4/1969 | Sainsbury . | |
| 3,471,111 | 10/1969 | MacDonald | 248/250 X |
| 3,704,675 | 12/1972 | Bellasalma . | |
| 4,385,565 | 5/1983 | Roberts et al. . | |
| 4,407,476 | 10/1983 | Bohannan . | |
| 4,429,850 | 2/1984 | Weber et al. | 108/108 X |
| 4,508,301 | 4/1985 | Nicholson et al. . | |
| 4,666,117 | 5/1987 | Taft | 248/250 X |
| 4,691,887 | 9/1987 | Bessinger | 248/250 |

*Primary Examiner*—Ramon O. Ramirez

[57] ABSTRACT

An elongated rigid wall mounted strip with a shelf receiving non-yielding channel or groove along the length thereof has resilient spring means acting on the bottom face of the shelf to fixedly retain the shelf in the channel. The strip has an upstanding backwall with apertures for receiving fasteners to secure the strip to a vertical wall or the like. The shelf receiving channel projects outwardly from this back and has a bottom leg wider than the top leg to underlie the shelf. This bottom leg has a resilient spring deflected and loaded by the shelf to wedge lock the shelf in the groove. A raised rib on the free end of the bottom leg bottoms the shelf as it is pushed into the groove permitting the shelf to be tilted so that its top face will fit under the top leg as the shelf is pushed into the groove to depress the spring on the bottom leg to a loaded level flush with the top face of the rib thereby securing the shelf to project perpendicularly or horizontally from the wall on which the strip is mounted. The spring may be an integral lip on the bottom leg or any one of a number of different separate spring configurations carried by the bottom leg. The top edge of the backwall is preferably grooved to receive the bottom edge of a picture, bookend or the like, and the back face of the backwall preferably has inwardly projecting top and bottom ribs or beads to bottom on the wall. The strip preferably extends the full length of the shelf but may be shorter than the shelf.

10 Claims, 3 Drawing Sheets

10
11
12
13
14
15
16
17
17a
18
19
20
21
22
23
24
25
M
S
W

CANTILEVER SHELF SUPPORT

FIELD OF THE INVENTION

This invention relates to the art of mounting shelves and the like on walls without requiring underlying brackets projecting from the walls and creating obstacles. Specifically, the invention deals with a cantilever shelf supporting strip attachable to a wall on which a shelf is to be mounted and having a rigid channel or groove along the length thereof tightly receiving a margin of the inner edge of the shelf and provided with spring means which wedge lock the shelf in the outwardly opening horizontal channel or groove.

PRIOR ART

Conventional wall mounted shelf supports have required angle brackets with one elongated leg secured to the wall on which the shelf is to be mounted and the other elongated leg projecting horizontally under the shelf for substantially the full width of the shelf. The shelf is then attached to the projected horizontal legs of the brackets by means of screws or other fasteners. These brackets are frequently unsightly and create obstacles under the shelf. While cantilever-type shelf supports attempting to minimize or eliminate the angle brackets have been proposed, these types of supports have required flexible jaws defining shelf receiving channels or grooves which must be expanded by the shelf. The flexible jaws cannot accommodate appreciable loads on the shelf and do not provide a rigid stationary shelf support.

It would therefore be an improvement in this art to provide cantilever-type shelf supports in the form of elongated wall mounted strips defining a rigid non-yielding channel or groove snuggly receiving the inner marginal edge of a shelf and having spring means which wedge lock this margin in the rigid groove or channel. Since the walls of the groove or channel are non-yielding, such supports will accommodate heavy loading of the shelves without deflection.

SUMMARY OF THE INVENTION

According to this invention, there is provided a rigid non-yielding wall mounted cantilever shelf support strip preferably formed of extruded aluminum to define an upstanding backwall to be bottomed on and secured to the vertical wall or panel of a room and having an outwardly opening channel or groove along the length thereof to tightly embrace a margin of the inner edge of a shelf to be mounted in the groove and with a bottom leg of the groove having spring means deflected by the shelf to wedge lock the shelf in the groove. The strip preferably extends the full length of the shelf but may be shorter to suit conditions. The spring may be in the form of an integral extruded lip or finger or any one of a number of different separate spring configurations carried by the bottom leg of the channel. This bottom leg has an upstanding ridge or rib on its free end providing a recess or dip between the rib and the spring so that the shelf can be upwardly inclined or cocked as it is pushed into the groove to facilitate the sliding of the top face of the shelf under the top leg of the groove. The top face of the rib or ridge is flush with the loaded or depressed level of the spring so that the shelf will project horizontally or at right angles to the backwall of the strip.

In a first illustrated form of the invention, the bottom leg of the channel or groove has an integral spring lip along the length thereof inclined upwardly and inwardly to underlie the inner free end of the upper leg of the channel or groove. This lip is depressed and loaded by the shelf as it is pushed into the channel and will wedge lock the shelf in the groove.

In a second illustrated form of the invention, the bottom leg of the channel has an undercut groove or well along the length thereof receiving one or more spring plates, with upwardly and inwardly inclined fingers or tangs, depressed and loaded by the shelf in the same manner as the lip. These spring plates are slidably received in the undercut well and may be positioned along the length of the strip as desired.

In other illustrated forms of the invention, the undercut well may receive plastic material spring members with bases fitting the well and with upstanding lips or fingers projecting above the bottom leg to be bent inwardly and loaded by the shelf. The plastic spring members may have bases in the form of flat strips or cylindrical beads with the wells being shaped to snugly or closely receive these bases. When the shelf is pulled outwardly in the channel, the inwardly bent lips will be frictionally dragged outwardly and will compress adjacent the base to further resist shifting of the shelf.

In still other illustrated forms, the plastic material springs may be resiliently compressible as they are deflected or loaded by the shelf to add stiffness to the wedge fit of the shelf in the channel or groove.

In a preferred embodiment, the cantilever shelf support strip is extruded rigid metal such as aluminum with a backwall about 2 inches high and about 0.10 to 0.13 inches thick. The back face of this wall has raised ribs extending the full length of the top and bottom ends of the wall. These ribs project from the back face of the wall about 0.03 to 0.05 inches and have a vertical height of about 0.1 inch. The top leg of the channel projects at right angles from the top of the backwall about ½ to 1 inch and has a rounded nose. This leg is sufficiently thick and rigid so that it will not yield relative to the backwall even when heavily loaded. An open top groove extends along the length of the backwall behind the lip providing a retainer for the bottom edge of a picture or the like to be mounted on the strip. The bottom leg of the channel is spaced below the top leg a distance about the same as the thickness of the shelf to be pushed into the groove so that the shelf will fit tightly in the groove. For conventional shelf boards this groove will be about ¾ inches high. The bottom leg of the groove is wider and thicker than the top leg, projecting from the backwall about 1 to 1½ inches with a raised rib on its inner free end being about 0.1 to 0.2 inches wide and about 0.075 to 0.10 inches high. The loaded or depressed levels of the spring memebers will be flush with the top of this rib. A plurality of screw holes are provided through the backwall under the top lip to attach the strip to a wall with the raised ribs on the backwall pressed against the support wall. The strip preferably extends the full length of the shelf and it is conveniently marketed in lengths of 3 to 6 feet, but it may be shorter, or even longer than the shelf, to suit conditions.

It will, of course, be understood that the above dimensions are given only as examples of preferred embodiments of the invention and may vary widely to suit conditions and different shelf dimensions.

The features of the inventions described above will be more fully understood by reference to the following detailed description of the accompanying drawings showing several embodiments of the invention:

ON THE DRAWINGS

BRIEF DESCRIPTIONS OF THE ILLUSTRATED EMBODIMENTS

Figures 1, 2, 3, 4:
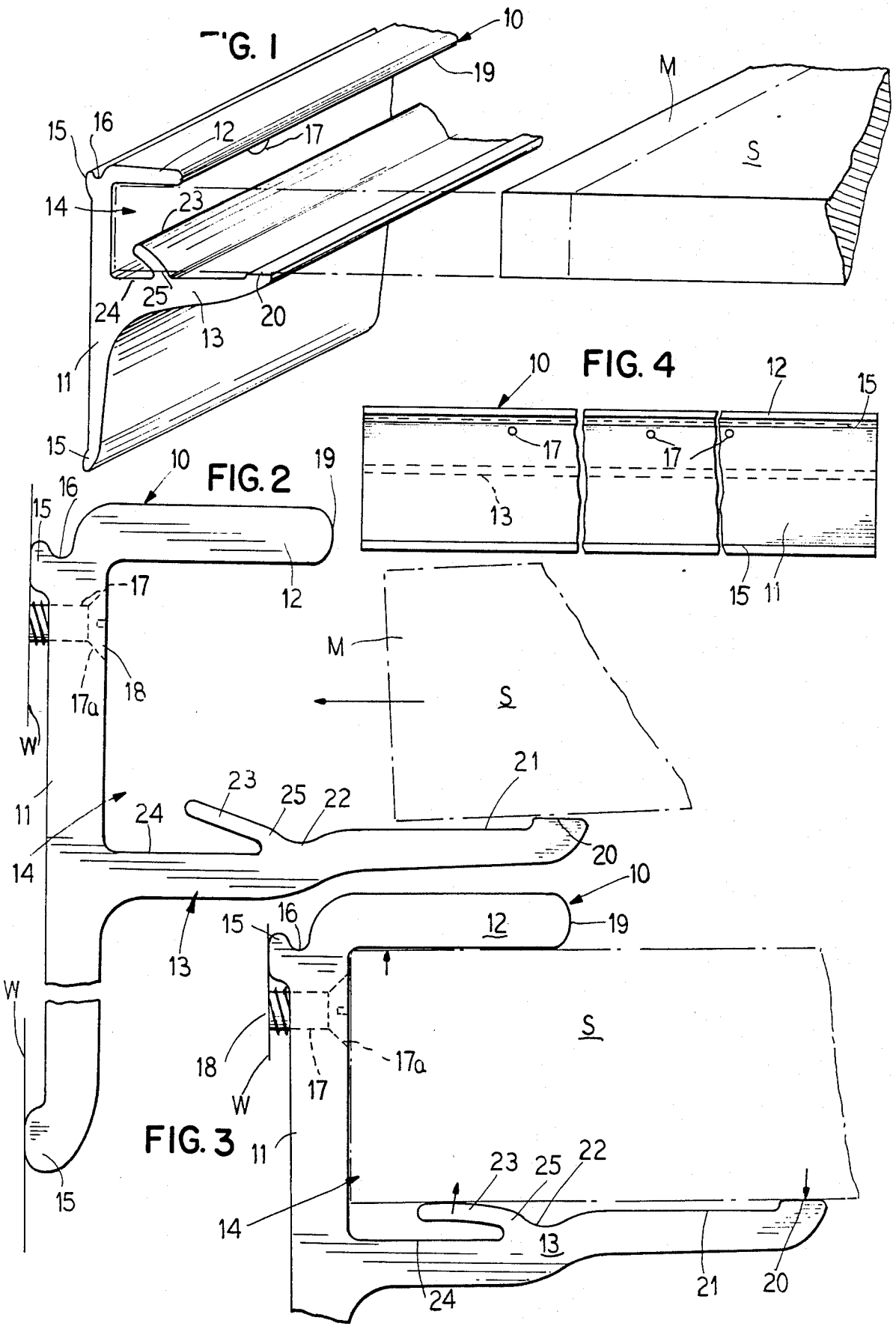
FIG. 1 is a fragmentary front and end perspective view of a cantilever shelf support strip of this invention and a shelf to be mounted in the channel or groove of the strip.
FIG. 2 is an enlarged broken end elevational view of the strip of FIG. 1 illustrating the manner in which the shelf is fed into the channel or groove.
FIG. 3 is a fragmentary end elevational view similar to FIG. 2 showing the shelf seated in the groove or channel of the strip.
FIG. 4 is a broken back elevational view of the strip of FIGS. 1–3.

The cantilever shelf support 10 of FIGS. 1–4 is a one-piece integral elongated extruded aluminum strip with an upstanding backwall 11, a projecting rigid top leg 12 extending outwardly at right angles to the top of this leg 11 and a wider and thicker bottom leg 13 parallel with the leg 12 and extending outwardly therebeyond to cooperate therewith in forming an outwardly opening channel or groove 14 along the full length of the strip. A shelf S has an inner edge margin M tightly fitting this channel or groove 14.

The backwall 11 has raised ribs 15 projecting from the back face thereof along the top and bottom of the wall. An open top groove 16 is provided in the top of the backwall 11 behind the top rib 15 and is adapted to receive the bottom edge of a picture, book end, or the like.

A plurality of fastener holes 17 are provided through the backwall 11 under the top rib 15 to receive screws 18 threaded into a wall W to secure the strip to the wall or other structure in a horizontal position with the channel or groove 14 opening into the room. These screw holes 17 are bevelled at **17*a* so that the heads of the screws 18 will fit flush or will be countersunk inwardly from the backwall of the groove 14**.

While the top leg 12 is level with or even slightly above the top rib 15 on the backwall 11, the bottom leg 13 is appreciably above the bottom rib 15 of leg 11 so that a substantial portion of this backwall 11 is below the leg 13. This extended backwall portion provides extra support resisting tilting of the strip on the wall under load. The raised ribs 15, when bottomed on the wall W as illustrated in FIG. 2 will grip the wall along the entire length of the strip when the fastners 18 are tightened in the wall. This localized bottoming of the strip along the top and bottom of the backwall prevents any uneveness in the wall from interfering with firm contact between the wall and strip.

The free end of the top leg 12 has a rounded nose 19 to guide the top face of the shelf S under the leg.

The bottom leg 13 is about twice as wide as the top leg 12 and has a raised rib or ridge 20 on its inner free end over which the bottom face of the shelf S can slide as the shelf is tilted upwardly to be pushed under the nose 19 of the top leg 12 as it enters the channel 14. A top surface 21 of the leg is thus at a level below the top face of the rib 20 and this surface is further depressed at 22 under the nose 19 of the top lip 12 and a spring lip or finger 23 then extends upwardly and is inclined towards the back of the channel or groove 14 overlying a still lower level top surface 24 of the leg. The lip or finger 23 can bend or rock about a zone 25 between the depressed portion 22 and the lower level portion 24 so that the finger 23 can swing from its upwardly and inwardly inclined free position of FIGS. 1 and 2 to its loaded depressed position of FIG. 3 which it assumes when the shelf S is bottomed in the groove 14. The variations in level of the top face of the leg 13 accommodate depressing the spring lip 23 to a level flush with the top face of the rib or ridge 20 when the shelf is bottomed in the groove 14 so that the shelf will be held horizontally and perpendicular to the backwall 11 of the strip.

The legs 12 and 13 are sufficiently thick and heavy so that they will not move relative to the backwall 11 even when the shelf S is wedged in the groove 14. The spring lip 23 when depressed by the shelf as illustrated in FIG. 3 will wedge lock the shelf in the groove and tilting of the shelf even under heavy loading cannot occur because the legs 12 and 13 of the groove will not yield to spread the channel 14.

As illustrated in FIGS. 1 and 2, the shelf S is easily pushed into the channel 14 by riding its bottom face on the rib 20 so that the top edge of the shelf will ride under the rounded nose 19 permitting the shelf to be advanced in the groove 14 to engage the spring lip 23 and when the shelf is driven home in the bottom of the groove or channel, the spring lip 23 will be flattened and the shelf will be supported by the ridge 20 of the bottom leg 13, the top face of the flat spring lip 23, the backwall 11 and the bottom face of the top leg 12.

Figure 5:
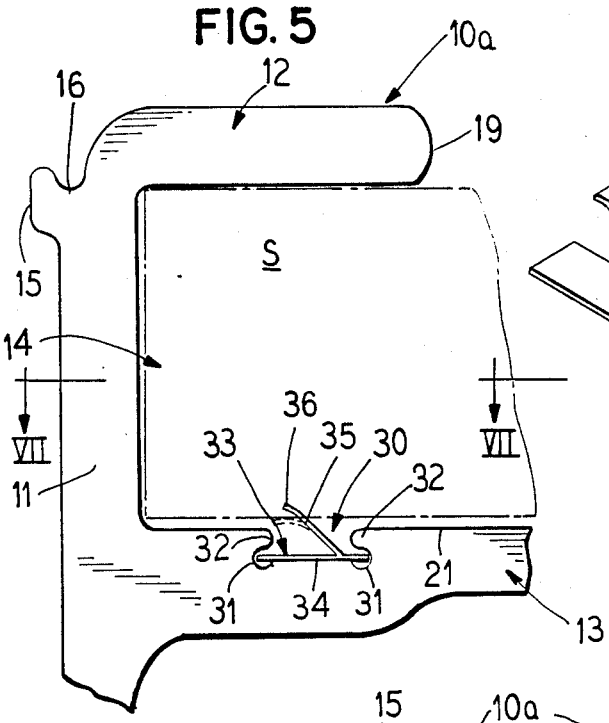
FIG. 5 is a view similar to FIG. 3 but illustrating a modified spring arrangement for the strip.
Figure 6:
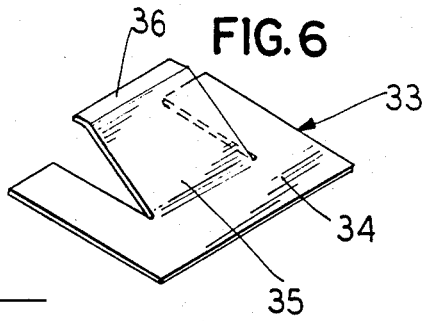
FIG. 6 is a perspective view of a plate spring for the FIG. 5 embodiment.
Figure 7:
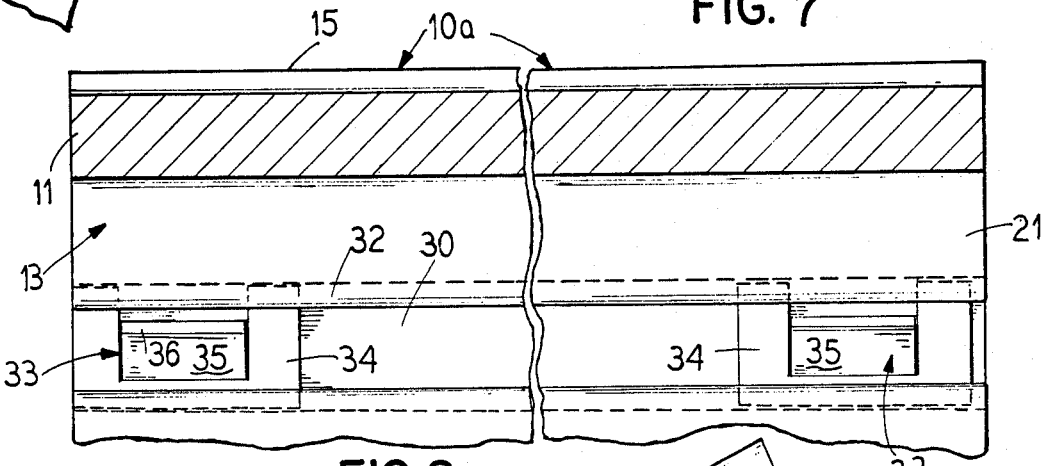
FIG. 7 is a broken fragmentary horizontal cross-sectional view along the line VII—VII of FIG. 5.

In the modified cantilever support strip **10*a* of FIGS. 5–7, parts which are substantially identical with the strip 10 of FIGS. 1–4** have been marked with the same reference numerals.

As shown in FIGS. 5 and 7, the top surface 21 of the leg 13 has an undercut well or groove 30 extending the full length of the leg parallel to the backwall 11 and under the top leg 12. This well is wider than deep and has undercut grooves 31 at the bottom corners thereof provided overhanging lips 32. Metal plate springs 33 have flat bases 34 bottomed in the well 30 and fitting in the grooves 31 to be retained in the well under the lips 32. The base 34 of the plate spring 33 can be inserted into the open ends of the well 30 and positioned at desired spaced intervals in the well as, for example, shown in FIG. 7, near the ends of the well. The base 34 is square or rectangular and has a lanced out raised spring finger 35 cut in one longitudinal edge thereof. The finger 35 slopes upwardly to project above the leg surface 21 and its free end 36 will engage the bottom face of the shelf to provide the wedge locking of the shelf in the channel or groove 14 in a matter similar to the wedge lock provided by the integral lip of the FIGS. 1–4 embodiment. The plate springs 33 need only be about 2 inches long and have a width to fit this well in the order of ¼ to ½ inch wide. The depth of the well need only be sufficient to provide rigid overhanging lips 32 for the undercuts 31.

Figure 8:
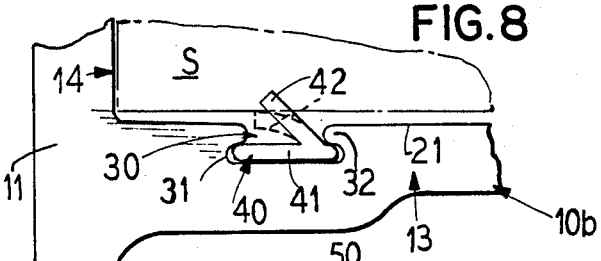
FIGS. 8–17 are fragmentary views similar to FIG. 5 and perspective views similar to FIG. 6 illustrating various embodiments of plastic material springs and spring mountings in the strip.
Figure 9:
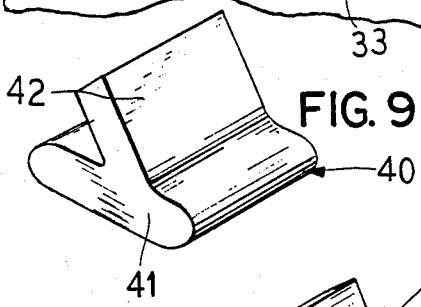

The embodiment 10b of FIGS. 8 and 9 has the same basic structure as the embodiment 10a of FIGS. 5–7 with the plate metal spring 33 being replaced with a molded plastic material spring 40. This spring 40 has a base 41 fitting the groove 31 of the well 30 in the bottom leg 13 and a resilient spring finger 42 slopes upwardly from this base 41 to function in the same manner as the finger 35 of the plate spring 33. If desired, a plurality of springs 40 could be used in the well 30 or a single elongated spring 40 could be provided.

Figure 10:
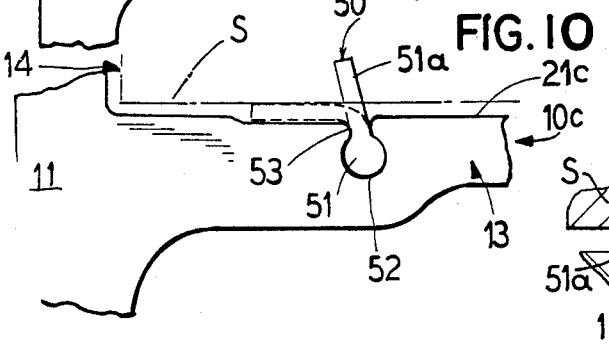
Figure 11:
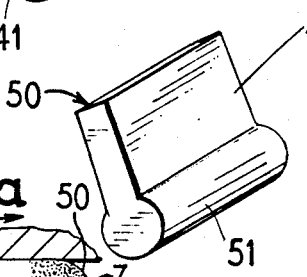

In the embodiment 10c of FIGS. 10 and 11, the configuration of the well in the leg 13 is modified in the form of a cylinder to fit a further modifed plastics material spring 50. This spring has a cylindrical rod-like base 51 with an extending flat rectangular finger 51a. The leg 13 of the strip 10c is provided with a cylindrical well 52 shaped to receive the rod base 51 of the spring 50 and has an open top slot 53 receiving the spring finger 51a therethrough. This spring finger 51a projects above the surface 21 of the leg 13 and is flattened by the shelf S as it is driven home in the groove or channel 14. The spring 50 thus functions in a manner similar to the springs 33 and 40.

Figure 12:
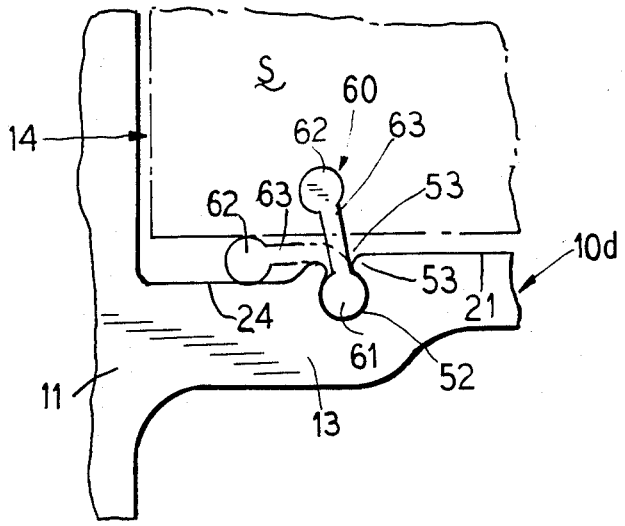
Figure 13:
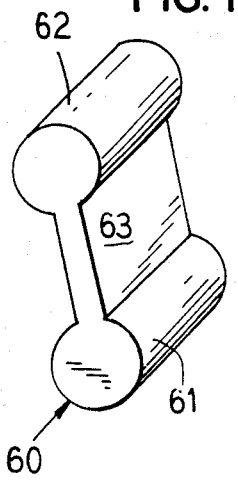

In the embodiment 10d of FIGS. 12 and 13, a further modified plastics material spring 60 is provided. This spring is dumbell shaped with cylindrical rod ends 61 and 62 on a central flat rectangular central lip portion 63. The rod end 61 fits the cylindrical groove 52 as in the FIG. 10c embodiment and the lip portion 63 projects freely through the slot 53 of this groove so that, as shown in FIG. 12 in its free condition, the rod portion 62 projects substantially above the surface 21 of the leg 13. The top surface of the leg 13 preferably has the depressed level 24 of the leg in the embodiment 10 and when the shelf is driven home in the groove 14, the rod portion 62 will be bottomed on this surface 24 and squeezed and flattened between the surface and the bottom face of the shelf S. The portion 63 will tilt to accommodate the swinging of the rod 62 from its free upright position to its flattened depressed position.

Figure 14:
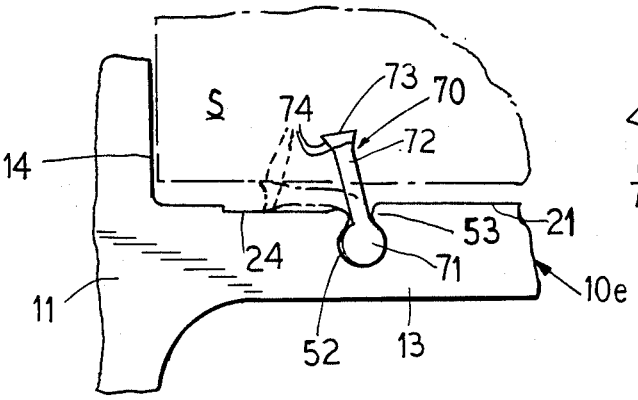
Figure 15:
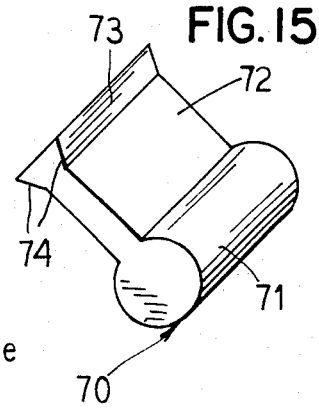

In the embodiment 10e of FIGS. 14 and 15, a further modified plastics material spring 70 is provided. This spring has a cylindrical rod end 71 fitting the groove 52 in the leg 13 with a flat rectangular finger portion 72 extending therefrom through the slot 53 of the groove 52. The free end of this finger portion 72 has a flared out lip 73 providing top and bottom tapered faces 74. The tapered faces are flattened and squeezed between the bottom of the shelf S and surface 24 of the lip 13. Thus, when the shelf S is shoved home in the groove 14, its bottom inner edge would engage the leg portion 72 bending it downwardly so that the bottom lip 74 will engage the surface 24 and the top lip 74 will engage the bottom of the shelf. The lips are then squeezed adding spring load to the spring member 70.

Figure 16:
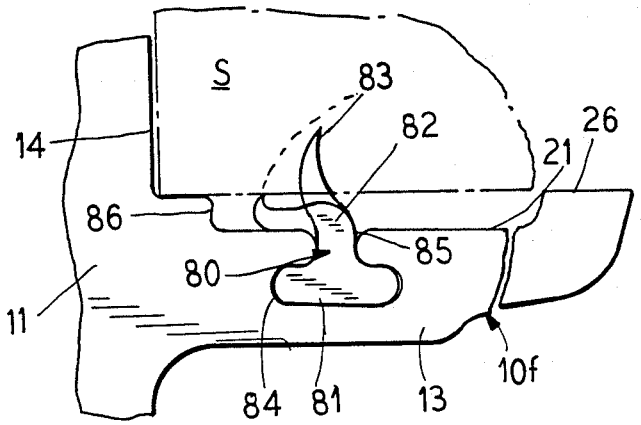
Figure 17:
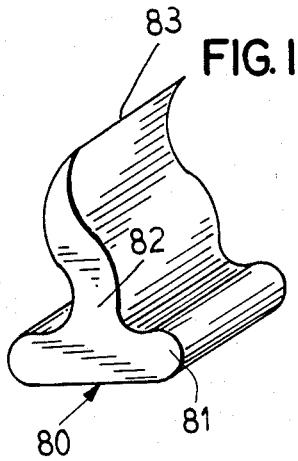

In the embodiment 10f of FIGS. 16 and 17, a further modified plastic material spring 80 is provided. This spring 80 is generally T-shaped with a head 81 and a curved tail 82 terminating an upwardly turned finger 83. The bottom leg 13 of the strip 10f has a T-slot groove 84 along the length thereof with the head 81 of the spring 80 snuggly fitting the groove and with the tail 82 of the spring projecting through the slot 85 of the groove. The finger tip end 83 of the tail 82, in its free condition, extends substantially above the surface 21 of the leg 13 and is engaged by the back face of the shelf S as it is shoved into the groove 14 to be depressed into the flattened condition as shown in FIG. 16 with the upturned tip tightly pressing the bottom face of the shelf. As shown, the channel 14 has a raised rib 86 adjacent to backwall 11 so that the shelf may rest on this rib when it is bottomed in the channel. The top surface of this rib is flush with the raised ridge or rib 20 on the free end of the leg 13.

The raised rib 86 is a potentional feature of the other embodiments 10, 10a–e to resist excessive deflection when an upward force is applied to the front or outer face of the shelf. However, owing to the requirements of manufacturing tolerances, the shelf will not normally rest on the rib under normal shelf loads.

The plastic material for the springs 40 and 50 may be composed of stiff but bendable polyvinyl chloride which is relatively incompressible so that the developed spring loads will be created by the deflection or flattening of the spring fingers. In addition, however, the springs 50, 60, 70 and 80 may be composed of plastic material such as a polyolefin, preferably polyurethane, which is not only flexible but is also resiliently compressible so that in the deflected or flattened condition of the spring, the material will be compressed to add spring force.

Figure 10A:
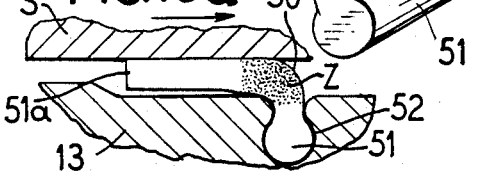

In the event of application of a load which attempts to withdraw the shelf outwardly from the channel 14, the deflected or flattened portions of the springs will be dragged with the shelf compressing the zone of the flattened portion adjacent its anchored end in the well causing it to thicken and increase the friction between the shelf and spring for resisting the withdrawal. FIG. 10a illustrates this feature showing the shaded bent zone Z between the base 51 and finger 52 as thickened by the dragging of the finger with the shelf as the shelf is pulled outwardly in the direction of the arrow. This feature also exists in the embodiments 10d–f.

From the above description, it should therefore be understood by those skilled in this art that this invention provides an elongated rigid cantilever shelf support strip forming a shelf receiving channel or groove which cannot be spread or deflected and wherein a wedge locking of the shelf in the channel or groove is provided by spring means carried by a leg of the channel. These spring means may be integral or separate from the channel leg.

We claim as our invention:

1. A cantilever shelf support which comprises an elongated rigid strip having a length substantially coextensive with the length of a shelf to be supported thereby and having an upright backwall, an integral rigid top leg projecting horizontally outwardly from said backwall, an integral rigid bottom leg in spaced parallel relation below said top leg projecting horizontally from said backwall, said top and bottom legs cooperating with said backwall to define a rigid non-yielding channel along the length of the strip opening outwardly to receive a shelf in snug fitting relation, said bottom leg having an integral upstanding rearwardly inclined spring finger along the length thereof projecting into the channel in its unloaded position and deflected toward the leg to a loaded position by a shelf being inserted into the channel to wedge lock the shelf in the channel supported by the legs, and means for mounting the backwall in upright position on a wall or structural member.

2. A cantilever shelf support which comprises an elongated extruded metal strip substantially commensurate in length with the length of a shelf to be supported thereby and having an upright backwall for mounting on a room wall or the like together with a pair of spaced parallel horizontal outwardly projecting rigid legs cooperating with the backwall to define a channel along the length of the strip, the backwall and legs being non-yieldable to prevent deflection of the channel, said bottom leg being wider than said top leg, and spring means carried by said bottom leg projecting into the channel toward and adjacent to said backwall to be deflected by a shelf as it is pushed into the channel to the backwall for wedge locking the shelf in the channel.

3. The shelf support of claim 2 wherein the bottom leg has an undercut well in the top face thereof and the spring means is retained in this well with a deflectable portion projecting into the channel.

4. The shelf support of claim 3 wherein the spring means is a metal plate with a base retained in the well and a lanced out finger projecting into the channel.

5. The shelf support of claim 3 wherein the spring means is a plastics material rod fitting the well and the deflectable portion is a finger projecting from this well.

6. The shelf support of claim 5 wherein the finger has a compressible free end.

7. The shelf support of claim 5 wherein the finger has a compressible enlarged end.

8. The shelf support of claim 5 wherein the finger has a curved tail with a lip end.

9. The shelf support of claim 3 wherein the deflectable portion is compressed and thickened when the shelf is pulled outwardly in the channel.

10. A cantilever shelf support for mounting on a wall to provide an outwardly opening channel to receive the inner edge margin of a shelf for projecting horizontally outward from the wall which comprises a rigid elongated strip commensurate in length with the length of a shelf to be supported, said strip having an upstanding back to be bottomed on a wall, fastener receiving apertures in said back to receive fasteners for securing the back in upright position bottomed on a wall, said back having an outwardly projecting horizontal top leg and a parallel outwardly projecting horizontal bottom leg spaced below the top leg and being wider than the top leg to project beyond the free end of the top leg, said back having an extended portion below said bottom leg, said legs and back defining a rigid non-yielding outwardly opening channel sized for tightly receiving the inner edge margin of a shelf, said bottom leg having an upwardly projecting spring underlying the top leg adapted to be deformed toward the back and bottom leg by a shelf as it is pushed into the channel, an upstanding ridge on the free end of the bottom leg flush with the deformed loaded position of the spring to cooperate therewith in maintaining the shelf in a flat horizontal position, and a top opening groove in the backwall behind the top leg adapted to receive the bottom edge of a picture.

* * * * *